US005223879A

United States Patent [19]

Chao

[11] Patent Number: 5,223,879

[45] Date of Patent: Jun. 29, 1993

[54] HAIR-STYLE SIMULATION CASSETTE

[76] Inventor: Chung-Liang Chao, No. 7-5, Lane 339, Wu Chuan Rd., Taichung, Taiwan

[21] Appl. No.: 877,856

[22] Filed: May 4, 1992

[51] Int. Cl.[5] ..... G03B 15/00

[52] U.S. Cl. ..... 354/292; 354/290; 354/291; 354/105; 353/28

[58] Field of Search ..... 354/105, 107, 290, 291, 354/292; 40/156, 446; 353/28

[56] References Cited

U.S. PATENT DOCUMENTS

| | | | |
|---|---|---|---|
| 149,724 | 4/1874 | Coolidge | 354/291 |
| 2,061,378 | 11/1936 | Henze et al. | 353/28 |
| 2,808,757 | 10/1957 | Scott | 353/28 |
| 2,899,860 | 8/1959 | Scott et al. | 353/28 |
| 3,018,100 | 1/1962 | Joseph | 354/290 |
| 3,339,453 | 9/1967 | Udich | 353/28 |
| 3,507,570 | 4/1970 | Bourdier et al. | 353/28 |
| 3,683,779 | 8/1972 | Lifton | 354/292 |
| 4,157,633 | 6/1979 | Reiner et al. | 353/28 |
| 4,434,467 | 2/1984 | Scott | 353/28 |
| 4,655,570 | 4/1987 | Jaffe | 354/107 |

FOREIGN PATENT DOCUMENTS

| | | | |
|---|---|---|---|
| 3345318A1 | 6/1985 | Fed. Rep. of Germany | 353/28 |
| 2221154A | 1/1990 | United Kingdom | 353/28 |

*Primary Examiner*—Monroe H. Hayes

*Attorney, Agent, or Firm*—Rosenblum, Parish & Isaacs

[57] ABSTRACT

A hair-style simulation cassette has a back strip, a U-shaped frame fixed to the back strip, a panel fixed to the U-shaped frame, a film fixed to the panel, and a photograph carrier receivable in the U-shaped frame. The photograph carrier has a cavity for receiving a photograph. The panel has a viewing window through which the photograph is visible and an adjusting window through which the photograph is adjustable.

1 Claim, 2 Drawing Sheets

HAIR-STYLE SIMULATION CASSETTE

BACKGROUND OF THE INVENTION

The present invention relates to a hair-style simulation cassette.

In modern days, permanent waves are popular among people. Generally, a person may look more appealing with a certain hair style than with another hair style. Therefore, the person may desire to foresee what he or she would look like with a hair style before the permanent wave. A plurality of computerized hair simulation systems have been utilized to help people to decide what hair styles are in their favor. A major problem of the computerized hair simulation systems is that they are too expensive for all beauty salons to afford. The present invention is intended to solve this problem.

SUMMARY OF THE INVENTION

The present invention provides a hair-style simulation cassette which has a back strip, a U-shaped frame fixed to the back strip, a panel fixed to the U-shaped frame, a film fixed to the panel, and a photograph carrier receivable in the U-shaped frame. The photograph carrier has a cavity for receiving a photograph. The panel has a viewing window through which the photograph is visible and an adjusting window through which the photograph is adjustable.

For a better understanding of the present invention and objects thereof, a study of the detailed description of the embodiments described hereinafter should be made in relation to the accompanying drawings.

DETAILED DESCRIPTION OF THE PREFERRED EMBODIMENT

Figure 1:
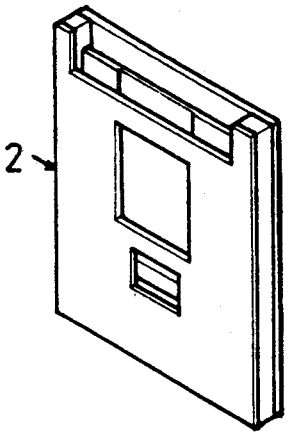
FIG. 1 is a perspective view of a hair-style simulation cassette in accordance with the present invention.

Referring to the drawings and, more particularly, to a FIG. 1, in accordance with the present invention, a hair-style simulation cassette 2 is shown in a perspective view.

Figure 2:
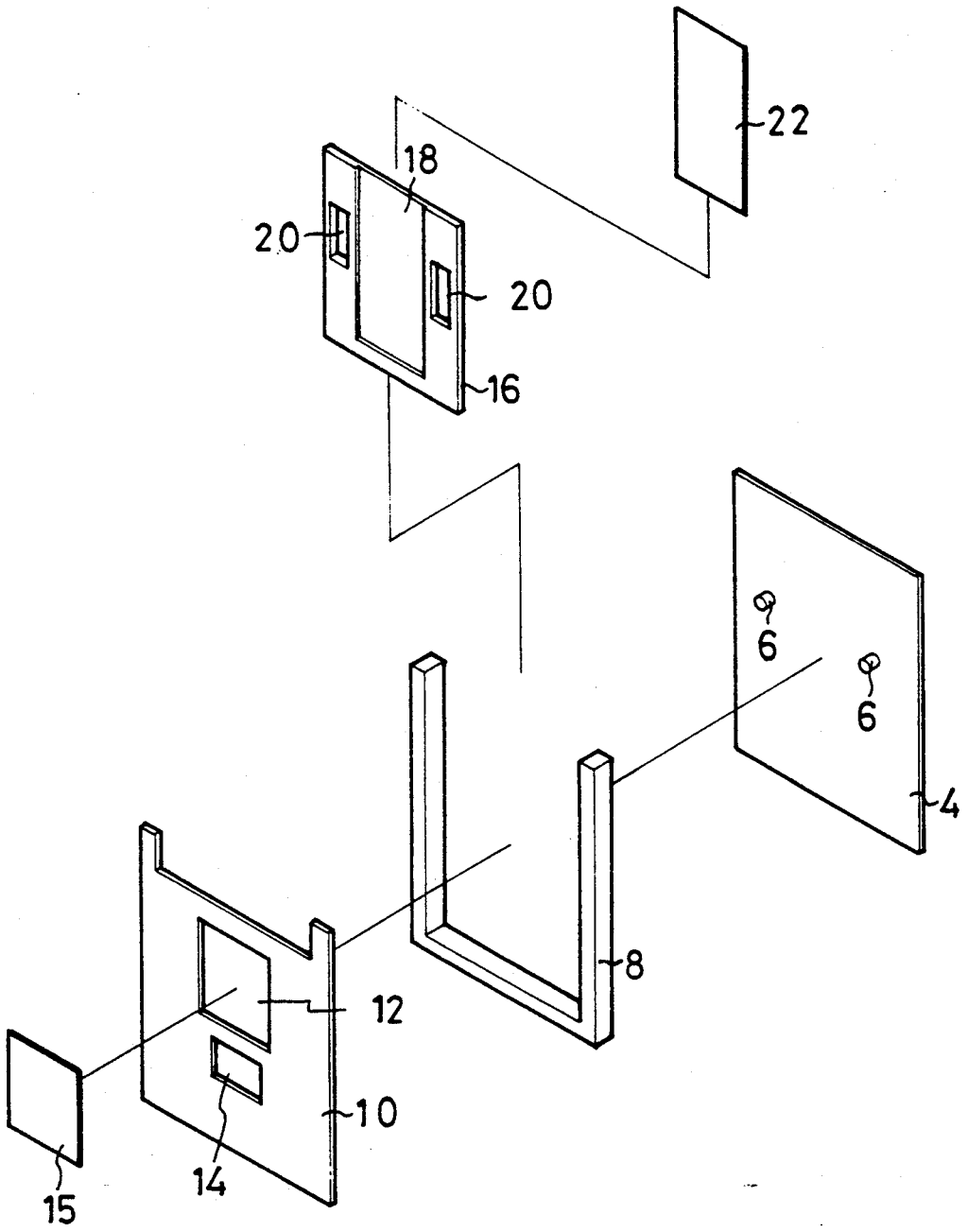
FIG. 2 is an exploded view of a hair-style simulation cassette in accordance with the present invention.

Referring to FIG. 2, a back strip 4 has two protrusions 6 projecting therefrom. A U-shaped frame 8 is fixed to the back strip 4 by suitable means, e.g., adhesion or threading. A panel 10 has a cutoff, a viewing window 12 below the cutoff, and an adjusting window 14 below the viewing window 12. A film 15 on which a hair style is printed is attached to the panel 10 by suitable means, e.g., adhesion, thereby sealing the viewing window 12. The panel 10 is fixed to the U-shaped frame by suitable means, e.g., adhesion or threading. The back strip 4, the U-shaped frame 8, and the panel 10 are combined, thereby forming a chamber between the back strip 4 and the panel 10 while the U-shaped frame 8 defines an opening. A photograph carrier 16 has a relatively thin rectangular central portion, thereby forming a cavity 18, and two slots 20 beside the cavity 18. A photograph 22 is received in the cavity 18.

The thickness of the U-shaped frame is greater than the length of the protrusion 6 plus the thickness of the photograph carrier 16, so that the photograph carrier 16 can be received in the chamber through the opening. The photograph 22 can be viewed through the film 15 as the film 15 is transparent, thereby forming an overlapped view of the film 15 and the photograph 22. Therefore, a person is able to foresee what he or she would look like with a certain hair style.

Figure 3:
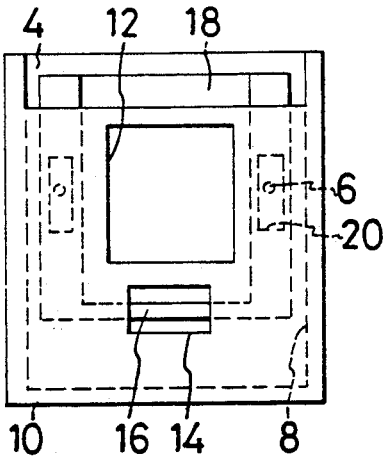
FIG. 3 is a plane view of a hair-style simulation cassette in accordance with the present invention.

Referring to FIG. 3, each protrusion 6 is inserted through each slot 20. The photograph carrier 16, together with the photograph 22, can be adjusted relative to the film 15 through the adjusting window 14, thereby obtaining a better alignment between the film 15 and the photograph 22.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

I claim:

1. A hair-style simulation cassette comprising:

a back strip having two protrusions perpendicularly projecting therefrom;

a U-shaped frame being fixed to said back strip;

a panel having a viewing window and an adjusting window being fixed to said U-shaped frame;

a film being fixed to said panel and aligned with said viewing window; and a photograph carrier having a cavity for receiving a photograph and two slots beside said cavity; said photograph carrier being receivable within said frame while each said protrusion is insertable through each said slot; said photograph being adjustable through said adjusting window of said panel.

* * * * *